US007677362B2

(12) United States Patent
Shimohata et al.

(10) Patent No.: US 7,677,362 B2
(45) Date of Patent: Mar. 16, 2010

(54) ACTUATOR DRIVING METHOD AND ACTUATOR DRIVING CIRCUIT

(75) Inventors: Kenji Shimohata, Tokyo (JP); Toshie Takeuchi, Tokyo (JP); Tae Hyun Kim, Tokyo (JP); Hiroshi Kigawa, Tokyo (JP); Tatsuo Matsuoka, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 953 days.

(21) Appl. No.: 10/578,842

(22) PCT Filed: Mar. 29, 2004

(86) PCT No.: PCT/JP2004/004448

§ 371 (c)(1),
(2), (4) Date: May 10, 2006

(87) PCT Pub. No.: WO2005/092768

PCT Pub. Date: Oct. 6, 2005

(65) Prior Publication Data

US 2007/0056808 A1 Mar. 15, 2007

(51) Int. Cl.
*B66B 1/32* (2006.01)

(52) U.S. Cl. ..... 187/288; 187/277; 187/290; 187/313

(58) Field of Classification Search ..... 187/277, 187/288, 290, 313
See application file for complete search history.

(56) References Cited

U.S. PATENT DOCUMENTS

| | | | | |
|---|---|---|---|---|
| 3,830,344 | A * | 8/1974 | Cervenec et al. | 188/171 |
| 4,535,879 | A * | 8/1985 | Sturges | 192/52.4 |
| 4,923,055 | A * | 5/1990 | Holland | 187/287 |
| 5,880,414 | A * | 3/1999 | Jaminet et al. | 187/316 |
| 6,039,151 | A * | 3/2000 | Ringel et al. | 187/207 |
| 6,100,655 | A * | 8/2000 | McIntosh | 318/159 |
| 6,966,409 | B2 * | 11/2005 | Wang | 187/290 |
| 2002/0053490 | A1 * | 5/2002 | Banno et al. | 187/290 |

FOREIGN PATENT DOCUMENTS

| | | |
|---|---|---|
| JP | 52-123052 | 10/1977 |
| JP | 58-29754 | 2/1983 |
| JP | 10-167638 | 6/1998 |
| JP | 11-29280 | 2/1999 |
| JP | 11-185582 | 7/1999 |
| JP | 2001-080840 | 3/2001 |
| JP | 2002-533281 | 10/2002 |
| JP | 2003-059384 | 2/2003 |

* cited by examiner

*Primary Examiner*—Walter Benson
*Assistant Examiner*—Kawing Chan
(74) *Attorney, Agent, or Firm*—Oblon, Spivak, McClelland, Maier & Neustadt, L.L.P.

(57) ABSTRACT

An actuator has a driving first coil and a driving second coil. A capacitor is electrically connected to both the first coil and the second coil through a discharge switch using electric power accumulated in a capacitor which can be selectively supplied. An operation portion for operating the discharge switch is electrically connected to the discharge switch. For example, when an electric power supplied to the operation portion is cut due to a power failure, the second coil and the capacitor are electrically connected to each other through the discharge switch.

9 Claims, 10 Drawing Sheets

| | STANDBY STATE | EMERGENCY OPERATION | RECOVERY OPERATION |
|---|---|---|---|
| NORMAL POWER FEEDING PHASE | ○ | ○ | ○ |
| POWER FAILURE PHASE | × | ○ | × |

| | STANDBY STATE | EMERGENCY OPERATION | RECOVERY OPERATION |
|---|---|---|---|
| NORMAL POWER FEEDING PHASE | ○ | ○ | ○ |
| PRESENCE OF BACKUP POWER SOURCE | ○ | ○ | ○ |
| ABSENCE OF BACKUP POWER SOURCE | × | ○ | × |

ACTUATOR DRIVING METHOD AND ACTUATOR DRIVING CIRCUIT

TECHNICAL FIELD

The present invention relates, for example, to an actuator driving method and an actuator driving circuit for driving an actuator for actuating a safety stop device or the like.

BACKGROUND ART

In order to prevent a car from falling, a safety stop device is used in a conventional elevator. JP 2001-80840 A discloses an elevator safety stop device for pressing a wedge against a guide rail for guiding a car to stop the car from falling. A conventional safety stop device for an elevator is operated by an actuator adapted to mechanically cooperate with a speed governor for detecting an abnormality of a raising and lowering speed of a car. In such a safety stop device for an elevator, the speed governor is mechanically cooperated with the actuator. Therefore, it takes some time to generate a braking force to the car after the detection of abnormality in the car speed.

In addition, if the actuator is electrically actuated in order to shorten the time required to generate the braking force to be applied to the car, there is a possibility that the actuator may not be actuated during a power failure. Consequently, the reliability of the operation of the safety stop device deteriorates.

DISCLOSURE OF THE INVENTION

The present invention has been made in order to solve the problems described above, and it is, therefore, an object of the present invention to obtain an actuator driving method and an actuator driving circuit which are capable of shortening the time required for actuation after an abnormality occurs and of enhancing the reliability of actuation during a power failure phase.

According to the present invention, there is provided an actuator driving method of driving an actuator having a driving electromagnetic coil electrically connected to a charge portion through a discharge switch, including, when an electric power supplied to an operation portion for operating the discharge switch is cut, causing a discharge from the charge portion to the electromagnetic coil by operating the discharge switch to drive the actuator.

BRIEF DESCRITION OF THE DRAWINGS

BEST MODE FOR CARRYING OUT THE INVENTION

Hereinafter, preferred embodiments of the present invention will be described with reference to the drawings.

EMBODIMENT 1

Figure 1:
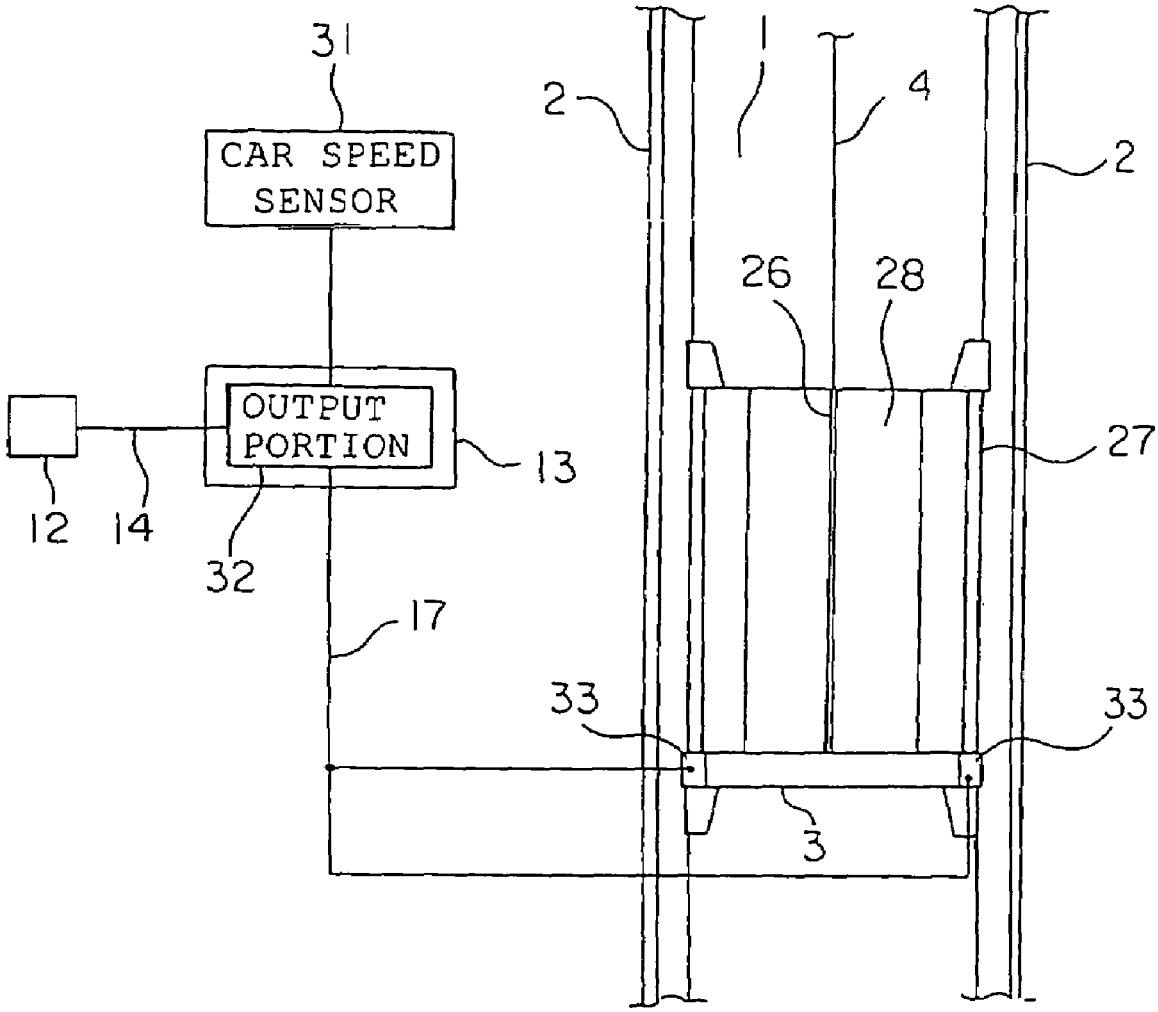
FIG. 1 is a schematic diagram showing an elevator apparatus according to Embodiment 1 of the present invention.

FIG. 1 is a schematic diagram showing an elevator apparatus according to Embodiment 1 of the present invention. Referring to FIG. 1, a pair of car guide rails 2 are arranged within a hoistway 1. A car 3 is guided by the car guide rails 2 as it is raised and lowered in the hoistway 1. Arranged at the upper end portion of the hoistway 1 is a hoisting machine (not shown) for raising and lowering the car 3 and a counterweight (not shown). A main rope 4 is wound around a drive sheave of the hoisting machine. The car 3 and the counterweight are suspended in the hoistway 1 by means of the main rope 4. Mounted to the car 3 are a pair of safety devices 33 opposed to the respective guide rails 2 and serving as braking means. The safety devices 33 are arranged on the underside of the car 3. Braking is applied to the car 3 upon actuating the safety devices 33.

The car 3 has a car main body 27 provided with a car entrance 26, and a car door 28 that opens and closes the car entrance 26. Provided in the hoistway 1 is a car speed sensor 31 serving as car speed detecting means for detecting the speed of the car 3, and a control panel 13 that controls the drive of an elevator.

Mounted inside the control panel 13 is an output portion 32 electrically connected to the car speed sensor 31. The battery 12 is connected to the output portion 32 through the power supply cable 14. Electric power used for detecting the speed of the car 3 is supplied from the output portion 32 to the car speed sensor 31. The output portion 32 is input with a speed detection signal from the car speed sensor 31.

A control cable (movable cable) is connected between the car 3 and the control panel 13. The control cable includes, in addition to multiple power lines and signal lines, an emergency stop wiring 17 electrically connected between the control panel 13 and each safety device 33.

A first overspeed which is set to be higher than a normal operating speed of the car 3 and a second overspeed which is set to be higher than the first overspeed are set in the output portion 32. The output portion 32 actuates a braking device of the hoisting machine when the raising/lowering speed of the car 3 reaches the first overspeed (set overspeed), and outputs an actuation signal that is actuating electric power to the safety stop device 33 when the raising/lowering speed of the car 3 reaches the second overspeed. The safety stop device 33 is actuated by receiving the input of the actuation signal.

Figure 2:
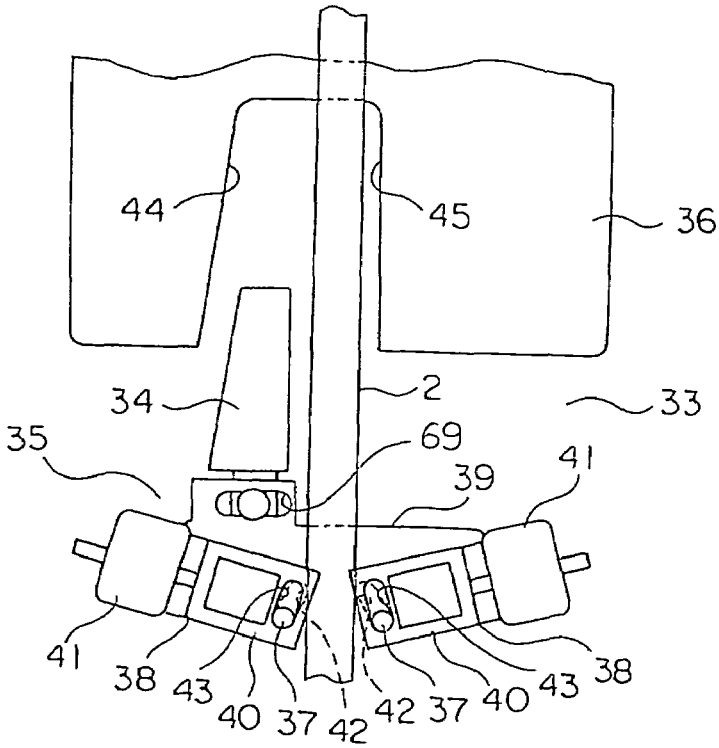
FIG. 2 is a front view showing the safety stop device shown in FIG. 1.
Figure 3:
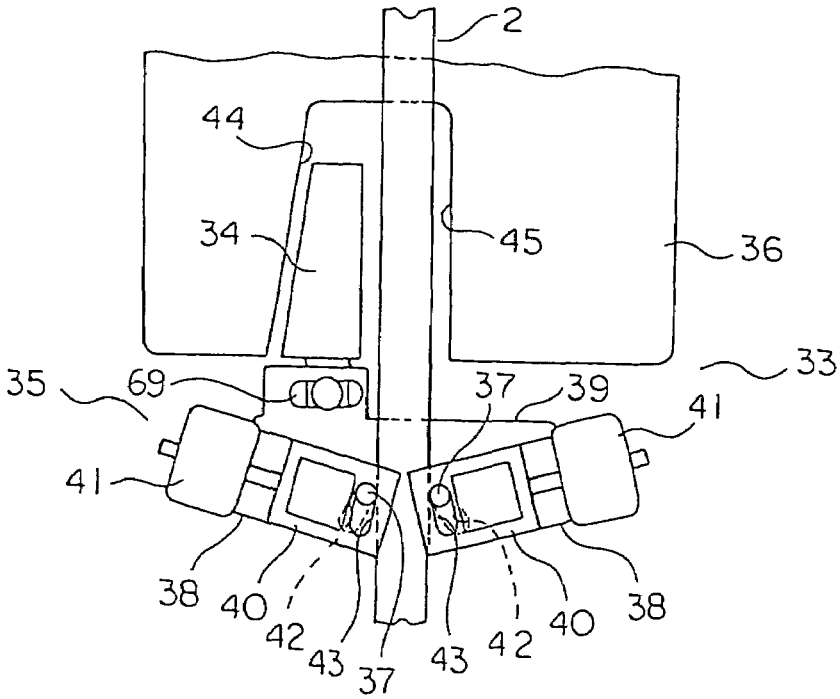
FIG. 3 is a front view of the safety stop device shown in FIG. 2 during the actuation phase.

FIG. 2 is a front view showing the safety stop device 33 shown in FIG. 1, and FIG. 3 is a front view of the safety stop device 33 shown in FIG. 2 during the actuation phase. In the drawings, the safety stop device 33 has a wedge 34 serving as a braking member which can be moved into and away from contact with the car guide rail 2, a support mechanism portion 35 connected to a lower portion of the wedge 34, and a guide portion 36 which is disposed above the wedge 34 and fixed to the car 3. The wedge 34 and the support mechanism portion 35 are provided so as to be vertically movable with respect to the guide portion 36. The wedge 34 is guided in a direction to come into contact with the car guide rail 2 of the guide portion 36 by its upward displacement with respect to the guide portion 36, i.e., its displacement toward the guide portion 36 side.

The support mechanism portion 35 has cylindrical contact portions 37 which can be moved into and away from contact with the car guide rail 2, actuation mechanisms 38 for displacing the respective contact portions 37 in a direction along which the respective contact portions 37 are moved into and away from contact with the car guide rail 2, and a support portion 39 for supporting the contact portions 37 and the actuation mechanisms 38. The contact portion 37 is lighter than the wedge 34 so that it can be readily displaced by the actuation mechanism 38. The actuation mechanism 38 has a contact portion mounting member 40 which can make the reciprocating displacement between a contact position where the. contact portion 37 is held in contact with the car guide rail .2 and a separated position where the contact portion 37 is separated away from the car guide rail 2, and an actuator 41 for displacing the contact portion mounting member 40.

The support portion 39 and the contact portion mounting member 40 are provided with a support guide hole 42 and a movable guide hole 43, respectively. The inclination angles of the support guide hole 42 and the movable guide hole 43 with respect to the car guide rail 2 are different from each other. The contact portion 37 is slidably fitted in the support guide hole 42 and the movable guide hole 43. The contact portion 37 slides within the movable guide hole 43 according to the reciprocating displacement of the contact portion mounting member 40, and is displaced along the longitudinal direction of the support guide hole 42. As a result, the contact portion 37 is moved into and away from contact with the car guide rail 2 at an appropriate angle. When the contact portion 37 comes into contact with the car guide rail 2 as the car 3 descends, braking is applied to the wedge 34 and the support mechanism portion 35, displacing them toward the guide portion 36 side.

Mounted on the upperside of the support portion 39 is a horizontal guide hole 69 extending in the horizontal direction. The wedge 34 is slidably fitted in the horizontal guide hole 69. That is, the wedge 34 is capable of reciprocating displacement in the horizontal direction with respect to the support portion 39.

The guide portion 36 has an inclined surface 44 and a contact surface 45 which are arranged so as to sandwich the car guide rail 2 therebetween. The inclined surface 44 is inclined with respect to the car guide rail 2 such that the distance between it and the car guide rail 2 decreases with increasing proximity to its upper portion. The contact surface 45 is capable of moving into and away from contact with the car guide rail 2. As the wedge 34 and the support mechanism portion 35 are displaced upward with respect to the guide portion 36, the wedge 34 is displaced along the inclined surface 44. As a result, the wedge 34 and the contact surface 45 are displaced so as to approach each other, and the car guide rail 2 becomes lodged between the wedge 34 and the contact surface 45.

Figure 4:
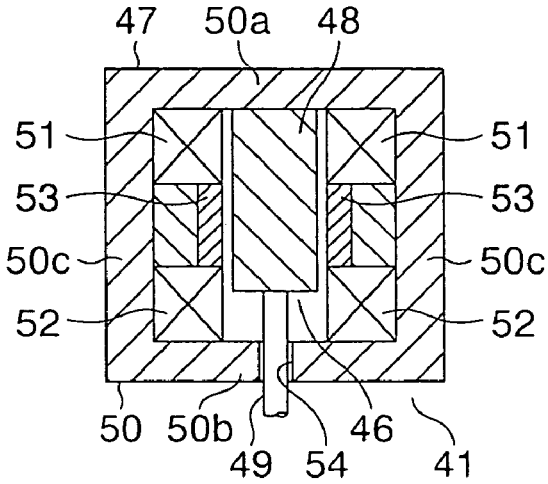
FIG. 4 is a schematic cross sectional view showing the actuator shown in FIG. 2.
Figure 5:
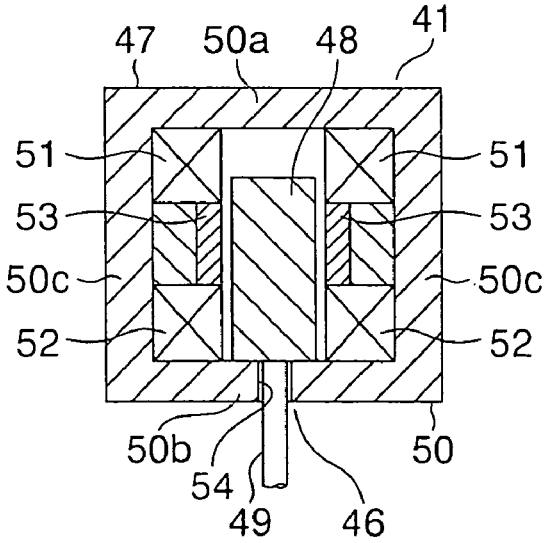
FIG. 5 is a schematic cross sectional view showing a state when the movable iron core shown in FIG. 4 is located in the actuation position.

FIG. 4 is a schematic cross sectional view showing the actuator 41 shown in FIG. 2. In addition, FIG. 5 is a schematic cross sectional view showing a state when the movable iron core 48 shown in FIG. 4 is located in the actuation position. In the drawings, the actuator 41 has a connection portion 46 connected to the contact portion mounting member 40 (FIG. 2), and a driving portion 47 for displacing the connection portion 46.

The connection portion 46 has a movable iron core (movable portion) 48 accommodated within the driving portion 47, and a connection rod 49 extending from the movable iron core 48 to the outside of the driving portion 47 and fixed to the contact portion mounting member 40. Further, the movable iron core 48 can be displaced between an actuation position (FIG. 5) where the contact portion mounting member 40 is displaced to the contact position to actuate the safety stop device 33 and a normal position (FIG. 4) where the contact portion mounting member 40 is displaced to the separated position to release the actuation of the safety stop device 33.

The driving portion 47 has: a fixed iron core 50 which has a pair of regulating portions 50*a* and 50*b* for regulating the displacement of the movable iron core 48 and a sidewall portion 50*c* for connecting therethrough the regulating portions 50*a* and 50*b* to each other and which encloses the movable iron core 48; a first coil 51 accommodated with in the fixed iron core 50 for displacing the movable iron core 48 in a direction along which the movable iron core 48 comes into contact with one regulating portion 50*a* by causing a current to flow through the first coil 51; a second coil 52 accommodated within the fixed iron core 50 for displacing the movable iron core 48 in a direction along which the movable iron core 48 comes into contact with the other regulating portion 50*b* by causing a current to flow through the second coil 52; and an annular permanent magnet 53 disposed between the first coil 51 and the second coil 52.

A through hole 54 through which the connection rod 49 is inserted is provided in the other regulating portion 50*b*. The movable iron core 48 abuts on one regulating portion 50*a* when being located in the normal position, and abuts on the other regulating portion 50*b* when being located in the actuation position.

The first coil 51 and the second coil 52 are annular electromagnetic coils surrounding the connection portion 46. In addition, the first coil 51 is disposed between the permanent magnet 53 and one regulating portion 50*a*, and the second coil 51 is disposed between the permanent magnet 53 and the other regulating portion 50*b*.

In a state in which the movable iron core 48 abuts on one regulating portion 50*a*, a space forming the magnetic resistance exists between the movable iron core 48 and the other regulating portion 50*b*. Hence, the amount of magnetic flux of the permanent magnet 53 becomes more on the first coil 51 side than on the second coil 52 side, and thus the movable iron core 48 is held in abutment with one regulating portion 50*a*.

Further, in a state in which the movable iron core 48 abuts on the other regulating portion 50*b*, a space forming the magnetic resistance exists between the movable iron core 48 and one regulating portion 50*a*. Hence, the amount of magnetic flux of the permanent magnet 53 becomes more on the second coil 52 side than on the first coil 51 side, and thus the movable iron core 48 is held in abutment with the other regulating portion 50*b*.

The electric power serving as the actuation signal from the output portion 32 is input to the second coil 52. When receiving the actuation signal as its input, the second coil 52 generates a magnetic flux acting against the force for holding the state in which the movable iron core 48 abuts on one regulating portion 50*a*. Also, an electric power serving as a recovery signal from the output portion 32 is input to the first coil 51. When receiving the recovery signal as its input, the first coil 51 generates a magnetic flux acting against the force for holding the state in which the movable iron core 48 abuts on the other regulating portion 50*b*.

Figure 6:
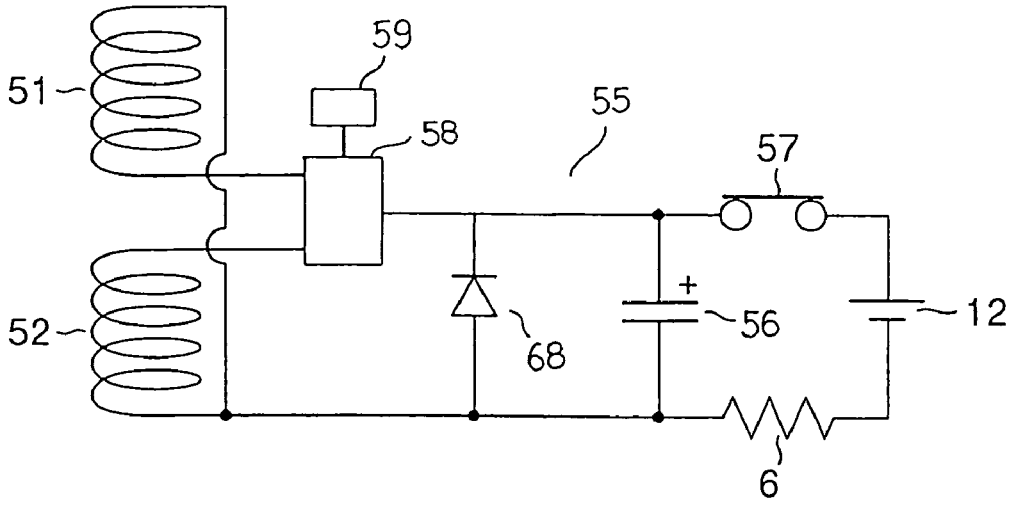
FIG. 6 is a circuit diagram showing a part of an internal circuit of the output portion shown in FIG. 1.

FIG. 6 is a circuit diagram showing apart of an internal circuit of the output portion 32 shown in FIG. 1. In the drawing, the output portion 32 is provided with a driving circuit 55 for supplying an electric power to the actuator 41 to drive the actuator 41. The driving circuit 55 has: a capacitor 56 serving as a charge portion in which an electric power from a battery 12 can be accumulated; a charge switch 57 for accumulating therethrough the electric power of the battery 12 in the capacitor 56; and a discharge switch 58 for selectively discharging the electric power accumulated in the capacitor 56 to a first coil 51 and a second coil 52. An operation portion 59 with which the discharge switch 58 is to be operated is electrically connected to the discharge switch 58. The movable iron core 48 (FIG. 4) is displaceable on the basis of the discharge of the electric power accumulated in the capacitor 56 to one of the first coil 51 and the second coil 52. It should be noted that an internal resistor 67 and a diode 68 are provided within the driving circuit 55.

Figure 7:
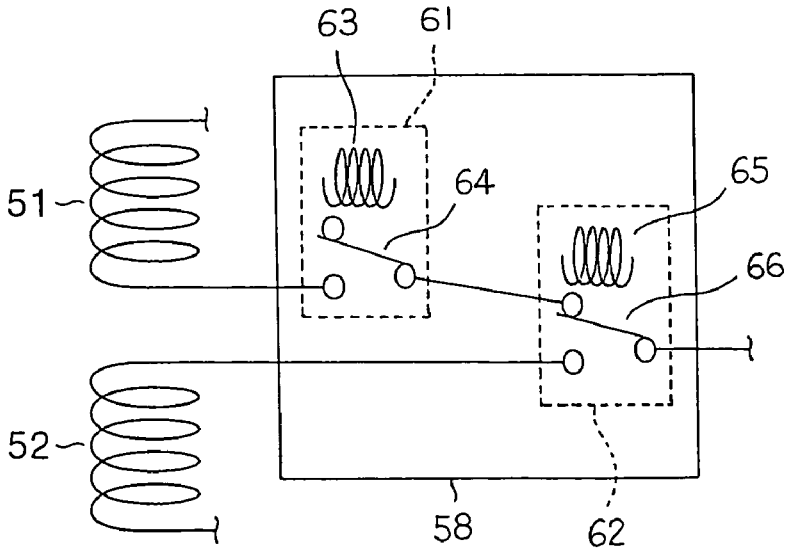
FIG. 7 is a circuit diagram showing the discharge switch shown in FIG. 6.

FIG. 7 is a circuit diagram showing the discharge switch 58 shown in FIG. 6. In the drawing, the discharge switch 58 has a first relay 61 for discharging therethrough the electric charges accumulated in the capacitor 56 in the form of a recovery signal to the first coil 51, and a second relay 62 for discharging therethrough the electric charges accumulated in the capacitor 56 in the form of an actuation signal to the second coil 52.

The first relay 61 is electrically connected to the first coil 51. The second relay 62 is electrically connected to the first relay 61, the second coil 52, and the capacitor 56, respectively.

The first relay 61 has a first relay coil 63 which is electrically connected to the operation portion 59 (FIG. 6), and a first contact portion 64, adapted to be disconnected by causing a current to flow through the first relay coil 63 from the operation portion 59 and adapted to be connected by stopping the current from flowing through the first relay coil 63 from the operation portion 59.

The second relay 62 has a second relay coil 65 which is electrically connected to the operation portion 59, and a second contact portion 66 serving as a power failure phase contact portion, adapted to be connected to the first coil 51 side by causing a current to flow through the second relay coil 65 from the operation portion 59 and adapted to be connected to the second coil 52 side by stopping the current from flowing through the second relay coil 65 from the operation portion 59.

When the first contact portion 64 is connected and the second contact portion 66 is connected to the first coil 51 side, the first coil 51 is electrically connected to the capacitor 56. When the second contact portion 66 is connected to the second coil 52 side, the second coil 52 is electrically connected to the capacitor 56. That is, the electrical connection to the capacitor 56 can be switched using the first relay 61 and the second coil 52 through the second contact portion 66.

That is, the electric power accumulated in the capacitor 56 is discharged to the second coil 52 by stopping the current from flowing through the second relay coil 65. In addition, the electric power accumulated in the capacitor 56 is discharged to the first coil 51 by stopping the current from flowing through the first relay coil 63 and by maintaining the current caused to flow through the second relay coil 65.

The actuator 41 is caused to execute the emergency operation through the discharge of the electric power accumulated in the capacitor 56 to the second coil 52. Also, the actuator 41 is caused to execute the recovery operation through the discharge of the electric power accumulated in the capacitor 56 to the first coil 51.

Next, a description will be given with respect to a method of driving the actuator 41.

Figures 8, 9:
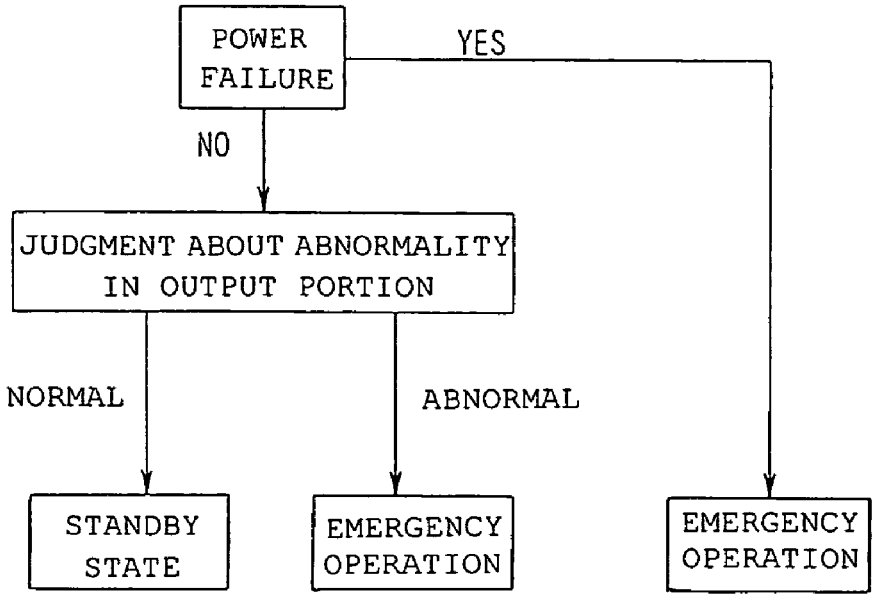
FIG. 8 is an explanatory diagram explaining a method of driving the actuator.
FIG. 9 is a table explaining operations of a safety stop device shown in FIG. 2 during a normal power feeding phase and during a power failure phase.

FIG. 8 is an explanatory diagram explaining a method of driving the actuator 41. In the drawing, for example, when the electric power stopped supplied to the operation portion 59 is cut due to a power failure or the like, the output portion 32 outputs an actuation signal to drive the actuator 41, thereby causing the safety stop device 33 to executes the emergency operation (S1). In addition, while the supply of the electric power to the operation portion 59 is maintained, the presence or absence of an abnormality in the speed of the car 3 is detected in the output portion 32 on the basis of information obtained from the car speed sensor 31 (S2). In this case, when the speed of the car 3 becomes higher than a previously set second overspeed, the speed of the car 3 is judged to be abnormal. When the speed of the car 3 is judged to be abnormal on the basis of the detection of the presence or absence of the abnormality in the speed of the car 3, the output portion 32 outputs an actuation signal to the actuator 41 to drive the actuator 41, thereby causing the safety stop device 33 to executes the emergency operation (S3). When the speed of the car 3 is judged to be normal, the output portion 32 outputs no actuation signal allowing the safety stop device 33 to maintain a standby state (S4).

In addition, while the supply of the electric power to the manipulation portion 59 is maintained, as shown in FIG. 9, the safety stop device 33 can executes the standby, the emergency operation, or the recovery operation (release operation). For example, when the electric power supplied to the operation portion 59 is cut due to a power failure or the like, the safety stop device 33 executes only the emergency operation on the basis of the output of the actuation signal from the output portion 32.

Next, a detailed operation will be described. During the normal operation phase, the contact portion mounting member 40 is located in a separated position, and the movable iron core 48 is located in a normal position. That is, the actuator 41 is in a standby state. In this state, a space defined between the wedge 34 and the guide portion 36 is maintained, and thus the wedge 34 is held separated from the car guide rail 2. In addition, the currents are caused to flow through the first relay coil 63 and the second relay coil 63, respectively, on the basis of the supply of the electric powers thereto from the operation portion 59. Consequently, the first contact portion 64 is disconnected and the second contact portion 66 is connected to the first coil 51 side. Moreover, the electric power of the battery 12 is accumulated in the capacitor 56 by turning ON the charge switch 57.

When the speed detected by the car speed sensor 31 reaches the first overspeed, the braking device of the hoisting machine is actuated. Thereafter, the speed of the car 3 continuously increases. When the speed detected by the car speed sensor 31 reaches the second overspeed, the current is stopped from flowing through the second relay coil 65 from the operation portion 59. As a result, the second contact portion 66 is connected to the second coil 65 side, and thus the electric power accumulated in the capacitor 56 is discharged in the form of the actuation signal to the second coil 52. That is, the actuation signal is outputted from the output portion 32 to each of the safety stop devices 33.

As a result, a magnetic flux is generated around the second coil 52 so that the movable iron core 48 is displaced from the normal position to the actuation position (FIG. 5). As a result, the contact portion 37 comes into contact with the car guide rail 2 to be pressed against the car guide rail 2 to brake the movement of the wedge 34 and the support mechanism portion 35 (FIG. 3). The movable iron core 48 is held in the actuation position while being held in abutment with the other regulating portion 50*b* by the magnetic power of the permanent magnet 53.

Since the car 3 and the guide portion 36 are lowered without being braked, the guide portion 36 is displaced to the side of the wedge 34 and the support mechanism 35 which are located below the guide portion 36. Is cut due to this displacement of the guide portion 36, the wedge 34 is guided along the inclined surface 44, and the car guide rail 2 is held between the wedge 34 and the contact surface 45. The wedge 34 is further displaced upward is cut due to its contact with the car guide rail 2 to be wedged in between the car guide rail 2 and the inclined surface 44. As a result, a large frictional force is generated between the car guide rail 2, and the wedge 34 and the contact surface 45, thereby completing the emergency operation of the safety stop device 33.

During the recovery phase, the electric power is supplied from the operation portion 59 to the first relay coil 63 and the second relay coil 65 to cause currents to flow through the first relay coil 63 and the second relay coil 65, respectively. As a result, the first contact portion 64 is disconnected, and the second contact portion 66 is connected to the first coil 51 side.

After that, the charge switch 57 is closed to charge the capacitor 56 again. Then, the electric power supply from the operation portion 59 to the first relay coil 63 is cut to close the first contact portion 64. The power charged in the capacitor 56 is discharged to the first coil 51 in the form of a recovery signal. That is, the recovery signal is transmitted from the output portion 32 to each of the safety stop devices 33. As a result, the first coil 51 is charged with electricity so that the movable iron core 48 is displaced from the actuation position to the normal position. The car 3 is raised in this state, thereby releasing the pressing of the wedge 34 and the contact surface 45 against the car guide rail 2.

For example, when the electric power supplied to the operation portion 59 is cut due to a power failure or the like, the electric power supplied from the operation portion 59 to both the first relay coil 63 and the second relay coil 66 is cut accordingly. At this time, the first contact portion 64 is connected and the second contact portion 66 is connected to the second coil 52 side. As a result, the electric power accumulated in the capacitor 56 is discharged to the second coil 52 so that the movable iron core 48 is displaced from the normal position to the actuation position. After that, the safety stop device 33 is caused to execute the emergency operation in the same manner as that described above.

With the method of driving the actuator 41 as described above, when the electric power supplied to the operation portion 59 is cut, the electric power accumulated in the capacitor 56 is discharged to the second coil 52 to drive the actuator 41. Hence, it is possible to reduce the abnormality in the operation of the actuator 41 is cut due to a power failure, and thus it is possible to enhance the reliability of the operation of the actuator 41. In addition, since the actuator 41 is electrically driven, it is possible to shorten the time required to actuate the actuator 41 after an abnormality occurs.

In addition, the safety stop device 33 for preventing the car 3 from falling is actuated by the driving of the actuator 41. Hence, even during the power failure phase, it is possible to electrically drive the actuator 41, and thus it is possible to shorten the time required to actuate the safety stop device 33 after the abnormality occurs. In addition, the safety stop device 33 can be more reliably actuated, and thus the car can be more reliably prevented from falling.

Moreover, since the driving circuit 55 is provided with the second contact portion 66 which is connected to the second coil 52 side when the electric power supply is cut, when a power failure occurs, the actuator 41 can still be driven. As a result, it is possible to shorten the time required to actuate the actuator 41 after an abnormality occurs, and it is also possible to enhance the reliability of the actuator 41.

EMBODIMENT 2

It should be noted that during the power failure phase, for example, the supply of the electric power to the output portion 32 may be maintained using a backup power source as a private power generator or the like.

Figures 10, 11:
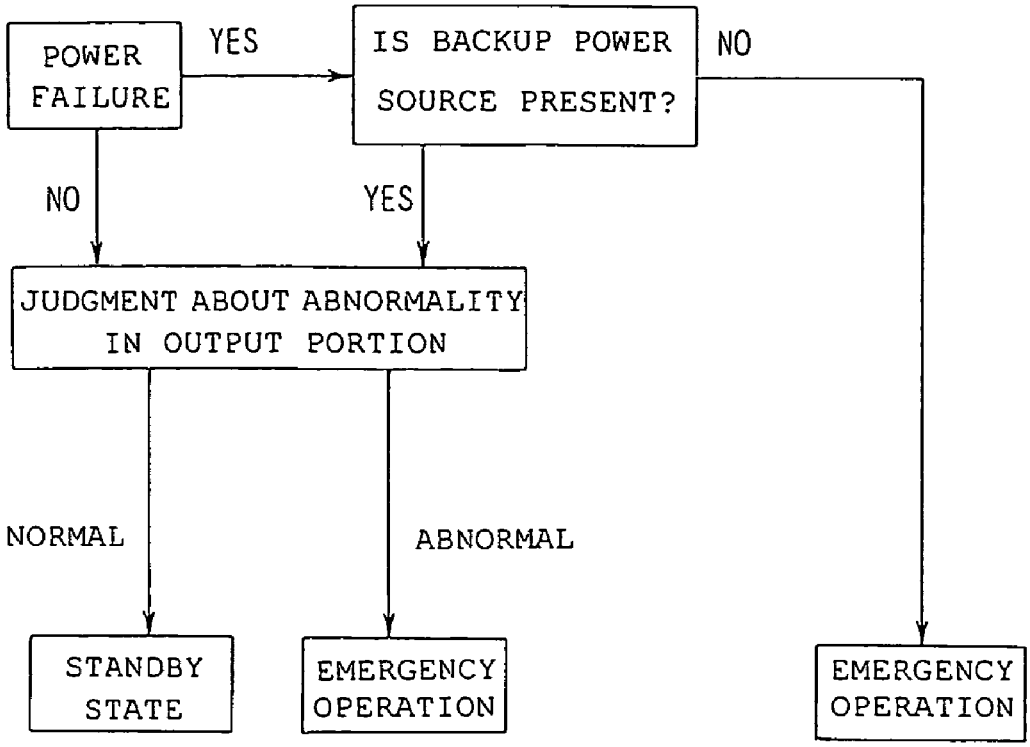
FIG. 10 is an explanatory diagram explaining a method of driving the actuator according to Embodiment 2 of the present invention.
FIG. 11 is a table explaining operations of a safety stop device according to Embodiment 2 of the present invention during a normal power feeding phase and during a power failure phase.

FIG. 10 is an explanatory diagram explaining a method of driving the actuator 41 according to Embodiment 2 of the present invention. In this example, during the power failure phase, the output portion 32 does not immediately output the actuation signal to the actuator 41. In this case, firstly, the output portion 32 detects whether or not the electric power is supplied from the backup power source to the operation portion 59 (S5).

When the electric power supplied to the operation portion 59 is cut, the output portion 32 outputs the actuation signal to the actuator 41 to drive the actuator 41, thereby causing the safety stop device 33 to executes the emergency operation (S1). On the other hand, when the electric power is supplied to the operation portion 59, it is detected by the output portion 32 whether or not there is the abnormality in the speed of the car 3 (S2).

When the speed of the car 3 is judged to be abnormal on the basis of the detection of the presence or absence of the abnormality in the speed of the car 3, the output portion 32 outputs the actuation signal to the actuator 41 to drive the actuator 41, thereby causing the safety stop device 33 to executes the emergency operation (S3). When the speed of the car 3 is judged to be normal, the output portion 32 outputs no actuation signal causing the safety stop device 33 to maintain a standby state (S4).

In addition, as shown in FIG. 11, when the normal supply of the electric power is maintained or the supply of the electric power to the operation portion 59 is maintained using the backup power source, the safety stop device 33 can executes the standby, the emergency operation, or the recovery operation. For example, when the electric power supplied to the operation portion 59 is cut due to a failure or the like of the backup power source during the power failure phase, the safety stop device 33 executes only the emergency operation on the basis of the output of the actuation signal from the output portion 32. It should be noted that the other operation in Embodiment 2 is the same as that in Embodiment 1.

With the method of driving the actuator 41 as described above, during the power failure phase, the supply of the electric power to the operation portion 59 is maintained by using the backup power supply. Hence, it is possible to utilize the supply of the electric power by the backup power source, and thus it is possible to reduce the frequency of the actuation of the actuator 41. As a result, it is possible to lengthen the life of the safety stop device 33.

EMBODIMENT 3

Figure 12:
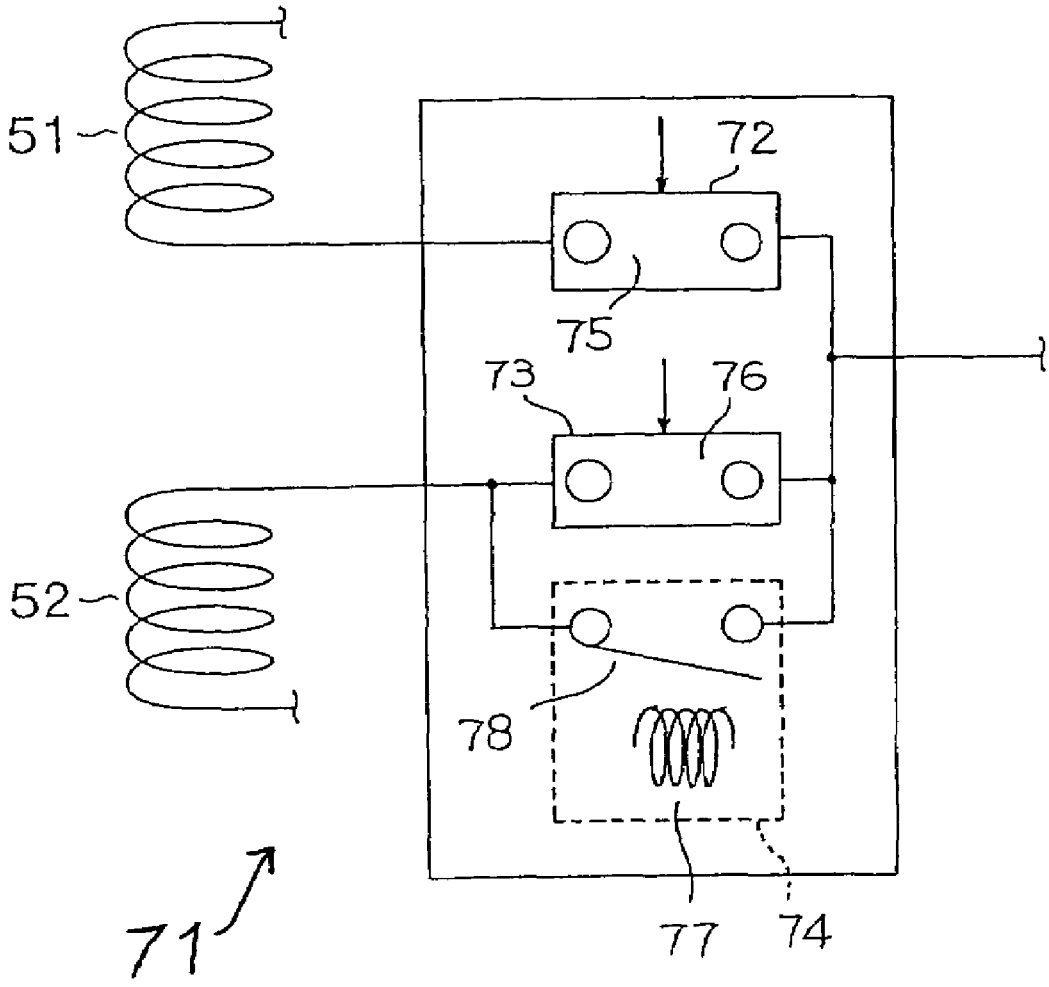
FIG. 12 is a circuit diagram showing a discharge switch in the driving circuit of an actuator according to Embodiment 3 of the present invention.

FIG. 12 is a circuit diagram showing a discharge switch in the driving circuit of an actuator according to Embodiment 3 of the present invention. In this example, a discharge switch 71 has: a first semiconductor switch 72 serving as a recovery switch for enabling/disabling therethrough the electrical connection to the first coil 51 and the capacitor 56; a second semiconductor switch 73 serving as an actuation switch for enabling/disabling therethrough the electrical connection to the second coil 52 and the capacitor 56; and a relay 74 serving as an actuation switch which is electrically connected in parallel with the second semiconductor switch 75 and which serves to enable/disable therethrough the electrical connection to the second coil 52 and the capacitor 56.

The first semiconductor switch 72 has a power supply phase contact portion 75 which is connected on the basis of input of a connecting signal as an electrical signal from the operation portion 59. The second semiconductor switch 73 has a power supply phase contact portion 76 which is connected on the basis of input of a connecting signal as an electrical signal from the operation portion 59. In addition, the relay 74 has a relay coil 77 which is electrically connected to the operation portion 59 (FIG. 6), and the power failure phase contact portion 78 which is disconnected by causing a current to flow through the relay coil 77 through the operation portion 59 and connected by stopping the current from flowing through the relay coil 77 from the operation portion 59.

Each of respective disconnection times of the first semiconductor switch 72 and the second semiconductor switch 73, i.e., each of respective connection times of the power supply phase contact portions 75 and 76 is set as being shorter than a connection time of the relay 74, i.e. a connection time of the power failure contact portion 78. In this example, each of the operating times of the first semiconductor switch 72 and the second semiconductor switch 73 is set as 1 ms, and the operating time of the relay 74 is set as 10 ms.

When the movable iron core 48 of the actuator 41 is displaced to the actuation position to actuate the safety stop device 33, the operation portion 59 outputs a turn-ON signal to the second semiconductor switch 73 and stops the electric power from being supplied to the relay coil 77. In addition, when the movable iron core 48 of the actuator 41 is displaced to the normal position to recover the safety stop device 33, the operation portion 59 stops the turn-ON signal from being outputted to the second semiconductor switch 73, causes a current to flow through the relay coil 77, and outputs a turn-ON signal to the first semiconductor switch 72. Other construction in Embodiment 3 is the same as that in Embodiment 1.

Next, an operation will be described. During the normal operation phase, the actuator 41 is in a standby state. In this state, the turn-ON signals are prevented from being outputted from the operation portion 59 to the first semiconductor switch 72 and the second semiconductor switch 73, respectively. In addition, the operation portion 59 supplies the electric power to the relay coil 77 and thus the power failure phase contact portion 78 is disconnected. Moreover, the electric power of the battery 12 is accumulated in the capacitor 56 through the charge switch 57.

When the speed detected by the car speed sensor 31 reaches the first overspeed, the braking device of the hoisting machine is actuated. Thereafter, the speed of the car 3 continuously increases. When the speed detected by the car speed sensor 31 reaches the second overspeed, the operation portion 59 stops the current from flowing through the relay coil 77, and outputs a turn-ON signal to the second semiconductor switch 73. As a result, the power feeding phase contact portion 76 and the power failure contact portion 78 are connected. Therefore, the electric power accumulated in the capacitor 56 is discharged in the form of the actuation signal to the second coil 52. That is, the actuation signal is outputted from the output portion 32 to each of the safety stop devices 33. The following operation is the same as that in Embodiment 1.

During the recovery phase, the turn-ON signal is stopped from being outputted to the second semiconductor switch 73 to open the power feeding phase contact portion 76, and the electric power is supplied from the operation portion 59 to the relay coil 77, thereby opening the power failure phase contact portion 78. After the capacitor 56 is charged again, the operation portion 59 outputs the turn-ON signal to the first semiconductor switch 72. As a result, the power feeding phase contact portion 75 is connected so that the electric power accumulated in the capacitor 56 is discharged to the first coil 51. The following operation is the same as that in Embodiment 1.

When the electric power supplied to the operation portion 59 is cut due to a power failure or the like, the turn-ON signals are stopped from being outputted from the operation portion 59 to the first semiconductor switch 72 and the second semiconductor switch 73, respectively, and the electric power supplied from the operation portion 59 to the relay coil 77 is also cut. At this time, the power feeding phase contact portions 75 and 76 are disconnected, and the power failure phase contact portion 78 is connected. As a result, the electric power accumulated in the capacitor 56 is discharged in the form of an actuation signal to the second coil 52, and the safety stop device 33 is caused to execute the emergency operation in the same manner as that in the foregoing.

In such a driving circuit, the connection speed of the power feeding phase contact portion 76 which is connected on the basis of the input of the connection signal is higher than that of the power failure phase contact portion 78. Hence, during the normal power feeding phase, it is possible to further shorten the time required to actuate the actuator 41 after an abnormality occurs. Moreover, during the power failure phase, the reliability of the operation of the actuator can be enhanced on the basis of the operation of the power failure phase contact portion 78.

It should be noted that during the power failure phase, the supply of the electric power to the output portion 32 may be maintained using the backup power source in the same manner as that in Embodiment 2. In this case, the method of driving the actuator 41 is identical to that in Embodiment 2.

EMBODIMENT 4

Figure 13:
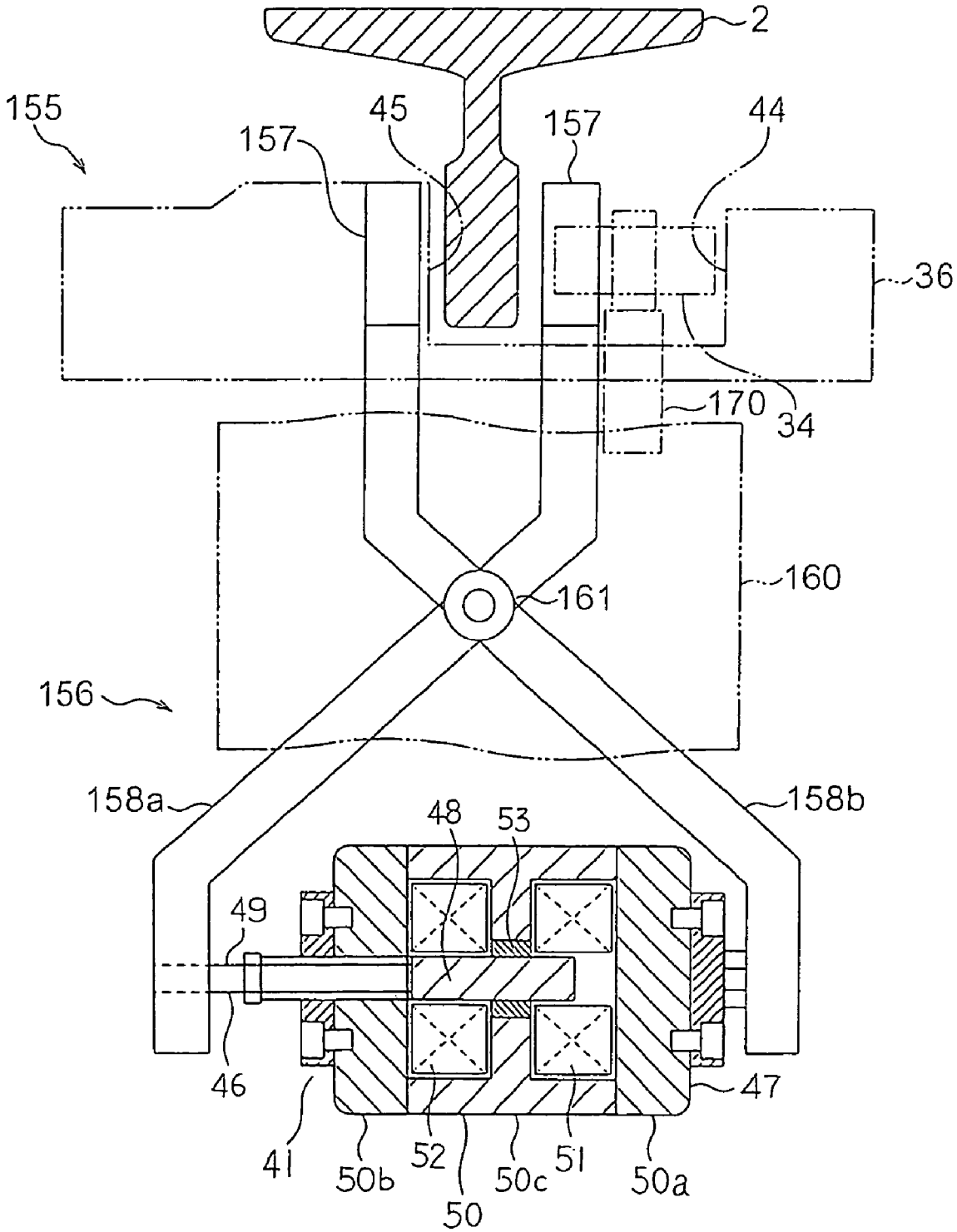
FIG. 13 is a plan view showing a safety device according to Embodiment 4 of the present invention.

FIG. 13 is a plan view showing a safety device according to Embodiment 4 of the present invention. Here, a safety device 155 has the wedge 34, a support mechanism portion 156 connected to a lower portion of the wedge 34, and the guide portion 36 arranged above the wedge 34 and fixed to the car 3. The support mechanism portion 156 is vertically movable with respect to the guide portion 36 together with the wedge 34.

The support mechanism portion 156 has a pair of contact portions 157 capable of moving into and away from contact with the car guide rail 2, a pair of link members 158*a*, 158*b* each connected to one of the contact portions 157, an actuator 41 for displacing the link member 158*a* relative to the other link member 158*b* such that the respective contact portions 157 move into and away from contact with the car guide rail 2, and a support portion 160 supporting the contact portions 157, the link members 158*a*, 158*b*, and the actuator 41. A horizontal shaft 170, which passes through the wedge 34, is fixed to the support portion 160. The wedge 34 is capable of reciprocating displacement in the horizontal direction with respect to the horizontal shaft 170.

The link members 158*a*, 158*b* cross each other at a portion between one end to the other end portion thereof. Further, provided to the support portion 160 is a connection member 161 which pivotably connects the link member 158*a*, 158*b* together at the portion where the link members 158*a*, 158*b* cross each other. Further, the link member 158*a* is provided so as to be pivotable with respect to the other link member 158*b* about the connection member 161.

As the respective other end portions of the link member 158*a*, 158*b* are displaced so as to approach each other, each contact portion 157 is displaced into contact with the car guide rail 2. Likewise, as the respective other end portions of the link member 158*a*, 158*b* are displaced so as to separate away from each other, each contact portion 157 is displaced away from the car guide rail 2.

The actuator 41 is displaced between the respective other end portions of the link members 158*a* and 158*b*. In addition, the actuator 41 is supported by each of the link members 158*a* and 158*b*. Moreover, the connection portion 46 is connected to one link member 158*a*. The fixed iron core 50 is fixed to the other link member 158*b*. The actuator 41 is pivotable together with the link members 158*a* and 158*b* about the connection member 161.

When the movable iron core 48 abuts regulating portion 50*a*, both of the contact portions 157 contact the car guide rail 2, and when the movable iron core 48 abuts the other regulating portion 50*b*, both of the contact portions 157 are separated away from contact with the car guide rail 2. That is, the movable iron core 48 is displaced to the actuation position by displacement in the direction to abut on the regulating portion 50*a*, and displaced to the normal position by the displacement in the direction to abut on the other regulating portion 50*b*. Other construction in Embodiment 4 is the same as that in Embodiment 1.

Next, operation will be described.

The operation by the time the actuation signal is output from the output portion 32 to each of the safety stop device 33 is the same as that in Embodiment 1.

When the actuation signal is input to each of the safety stop devices 33, a magnetic flux is generated around the first coil 51 so that the movable iron core 48 is displaced in the direction approaching the regulating portion 50*a* and thus displaced from the normal position to the actuation position. At this time, the contact portions 157 are displaced in a direction approaching each other to come into contact with the car guide rail 2. As a result, the wedge 34 and the support mechanism portion 156 are braked.

After that, the guide portion 36 continues to lower to approach the wedge 34 and the support mechanism portion 156. As a result, the wedge 34 is guided along the inclined surface 44 so that the car guide rail 2 is held between the wedge 34 and the contact surface 45. After that, the car 3 is braked through the same operations as those in Embodiment 1.

During the recovery phase, a recovery signal is transmitted from the output portion 32 to the second coil 52. As a result, a magnetic flux is generated around the second coil 52 so that the movable iron core 48 is displaced from the actuation position to the normal position. After that, the press contact of the wedge 34 and the contact surface 45 with the car guide rail 2 is released in the same manner as that in Embodiment 1.

With the elevator apparatus as well using the safety stop device 155 as described above, the driving circuit (FIGS. 7 and 12) shown in Embodiment 1 or 2 is provided in the output portion 32, thereby making it possible to further enhance the reliability of the operation.

EMBODIMENT 5

Figure 14:
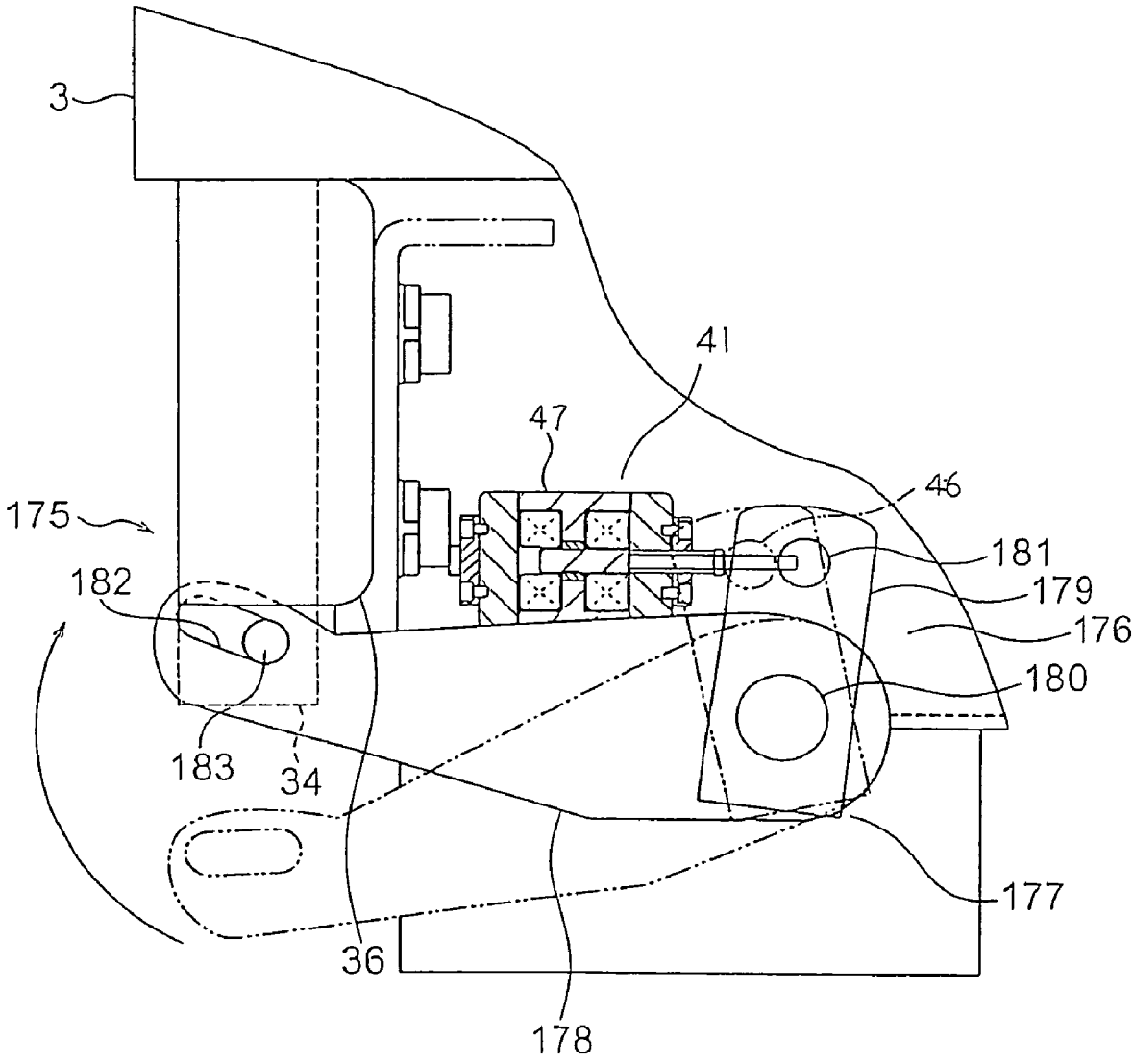
FIG. 14 is a partially cutaway side view showing a safety device according to Embodiment 5 of the present invention.

FIG. 14 is a partially cutaway side view showing a safety device according to Embodiment 5 of the present invention. Referring to FIG. 14, a safety device 175 has the wedge 34, a support mechanism portion 176 connected to a lower portion of the wedge 34, and the guide portion 36 arranged above the wedge 34 and fixed to the car 3.

The support mechanism portion 176 has the actuator 41 constructed in the same manner as that of Embodiment 1, and a link member 177 displaceable through displacement of the connection portion 46 of the actuator 41.

The actuator 41 is fixed to a lower portion of the car 3 so as to allow reciprocating displacement of the connection portion 46 in the horizontal direction with respect to the car 3. The link member 177 is pivotably provided to a stationary shaft 180 fixed to a lower portion of the car 3. The stationary shaft 180 is arranged below the actuator 41.

The link member 177 has a first link portion 178 and a second link portion 179 which extend in different directions from the stationary shaft 180 taken as the start point. The overall configuration of the link member 177 is substantially a prone shape. That is, the second link portion 179 is fixed to the first link portion 178, and the first link portion 178 and the second link portion 179 are integrally pivotable about the stationary shaft 180.

The length of the first link portion 178 is larger than that of the second link portion 179. Further, an elongate hole 182 is provided at the distal end portion of the first link portion 178. A slide pin 183, which is slidably passed through the elongate hole 182, is fixed to a lower portion of the wedge 34. That is, the wedge 34 is slidably connected to the distal end portion of the first link portion 178. The distal end portion of the connection portion 46 is pivotably connected to the distal end portion of the second link portion 179 through the intermediation of a connecting pin 181.

The link member 177 is capable of reciprocating movement between a normal position where it keeps the wedge 34 separated away from and below the guide portion 36 and an actuating position where it causes the wedge 34 to wedge in between the car guide rail and the guide portion 36. The connection portion 46 is projected from the drive portion 163 when the link member 177 is at the normal position, and it is retracted into the drive portion 163 when the link member is at the actuating position. Other constructions in Embodiment 5 are the same as in Embodiment 1.

Next, an operation will be described. The operation until the actuation signal is outputted from the output portion 32 to each of the safety stop devices 175 is the same as that in Embodiment 1.

When the actuation signal is inputted to each of the safety stop devices 175, the connection portion 46 is moved forward. As a result, the link member 177 is caused to pivot around the fixed shaft 180 to be displaced to the actuator position. As a result, the wedge 34 comes into contact with the guide portion 36 and the car guide rail to be wedged in between the guide portion 36 and the car guide rail so that the car 3 is braked.

During the recovery phase, the recovery signal is transmitted from the output portion 32 to the safety stop device 175, and the connection portion is moved in a backward direction. In this state, the car 3 is raised to release the wedging of the wedge 34 between the guide portion 36 and the car guide rail.

With the elevator apparatus using the safety stop device 175 as described above, the driving circuit (FIGS. 7 and 12) shown in Embodiment 1 or 2 is provided in the output portion 32, thereby making it possible to further enhance the reliability of the operation.

EMBODIMENT 6

Figure 15:
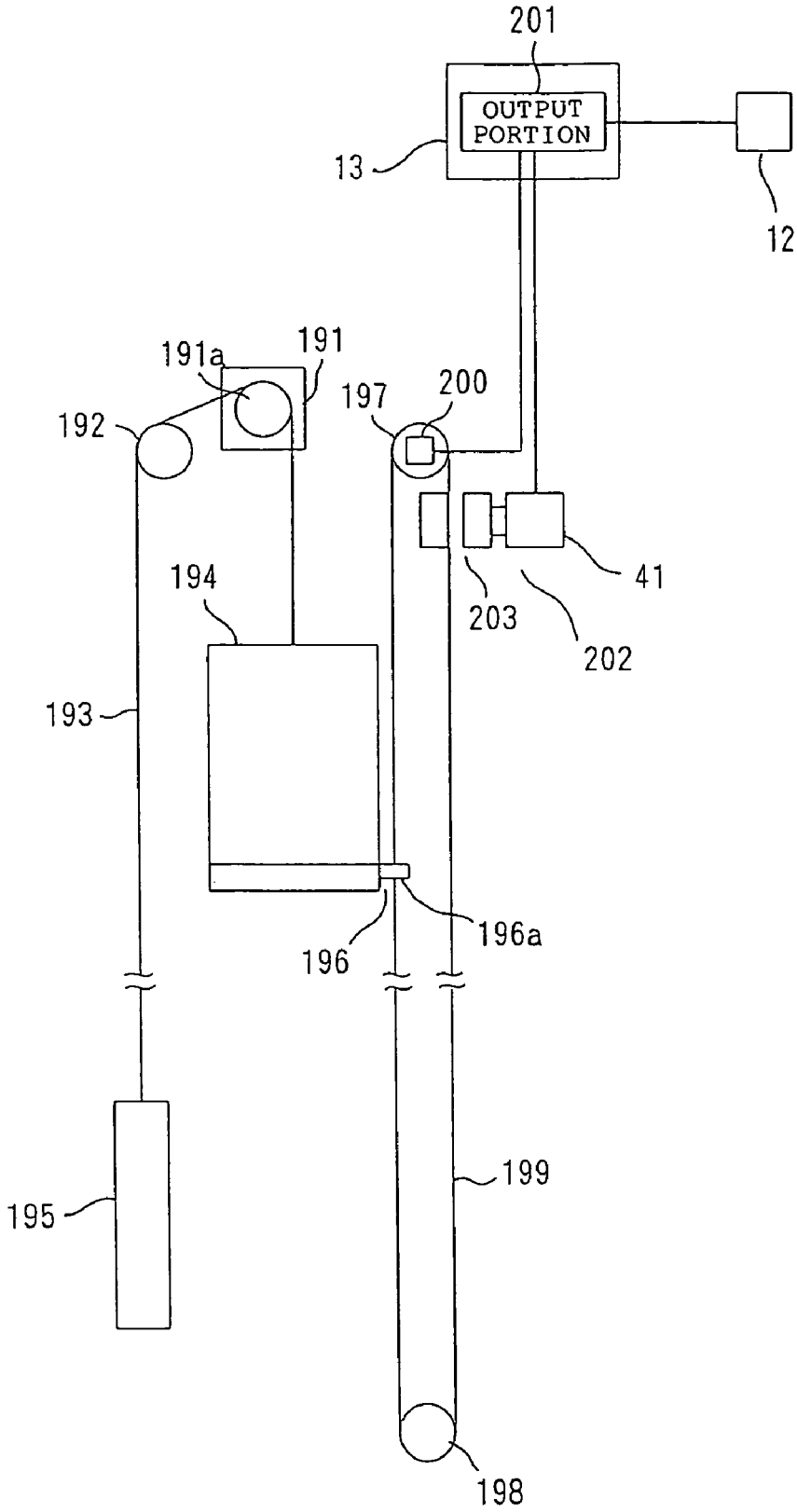
FIG. 15 is a constructional view showing an elevator apparatus according to Embodiment 6 of the present invention.

FIG. 15 is a constructional view showing an elevator apparatus according to Embodiment 6 of the present invention. A driving device (hoisting machine) 191 and a deflector sheave 192 are provided in an upper portion within a hoistway. A main rope 193 is wrapped around a driving sheave 191*a* of the driving device 191 and the deflector 192. A car 194 and a counter weight 195 are suspended in the hoistway by means of the main rope 193.

A mechanical safety stop device 196 which is engaged with a guide rail (not shown) in order to stop the car 194 in case of emergency is installed in a lower portion of the car 194. A speed governor sheave 197 is disposed in the upper portion of the hoistway. A tension sheave 198 is disposed in a lower portion of the hoistway. A speed governor rope 199 is wrapped around the speed governor sheave 197 and the tension sheave 198. Both end portions of the speed governor rope 199 are connected to an actuator lever 196*a* of the safety stop device 196. Consequently, the speed governor sheave 197 is rotated at a speed corresponding to a running speed of the car 194.

The speed governor sheave 197 is provided with a sensor 200 (e.g., an encoder) for outputting a signal used to detect the position and a speed of the car 194. The signal from the sensor 200 is input to the output portion 201 installed in the control panel 13.

A speed governor rope holding device 202 for holding the speed governor rope 199 to stop its circulation is provided in the upper portion of the hoistway. The speed governor rope holding device 202 has a hold portion 203 for holding the speed governor rope 199, and an actuator 41 for driving the hold portion 203. The construction of the actuator 41 is the same as that of the actuator 41 in Embodiment 1.

When the actuation signal from the output portion 201 is input to the speed governor rope holding device 202, the hold portion 203 is displaced by the driving force of the actuator 41 to stop the movement of the speed governor rope 199. When the movement of the speed governor rope 199 is stopped, the actuation lever 196*a* is manipulated by the movement of the car 194, and the safety stop device 196 is then operated to stop the car 194.

In this way even with such an elevator apparatus that inputs the actuation signal from the output portion 201 to the speed governor rope holding device 202 utilizing the electromagnetic drive system, the driving circuit (FIGS. 7 and 12) shown in Embodiment 1 or 2 is provided in the output portion 201, thereby making it possible to further enhance the reliability of the operation.

It should be noted that while in each of embodiments described above, the driving circuit for the actuator 41 is provided in the control panel for controlling the operation of the elevator, when a safety device is used separately from the control panel, the driving circuit for the actuator 41 may be provided in the safety device. In this case, the safety device, for example, is installed in the car.

Also, while in each of embodiments described above, the electrical cable is used as the transmission means for supplying therethrough the electric power from the output portion to the safety stop device, a wireless communication device having a transmitter provided in the output portion and a receiver provided in the safety stop device may also be used instead. Alternatively, an optical fiber cable for transmitting therethrough an optical signal may also be used.

Moreover, in each of embodiments described above, the safety stop device applies the braking in the case of the overspeed of the car in the downward direction. However, the safety stop device may apply braking in the case of the overspeed of the car in the upward direction by using the safety stop device fixed to the car upside down.

The invention claimed is:

1. An actuator driving circuit for discharging an electric power accumulated in a charge portion to an electromagnetic coil in order to drive an actuator having the electromagnetic coil, comprising:

a discharge switch including a power failure phase contact portion which is connected when an electric power supply is cut, and a power feeding phase contact portion which is operated based on an input of an electrical signal and has an operating speed higher than that of the power failure phase contact portion, wherein an electric power accumulated in the charge portion is discharged to the electromagnetic coil as a result of an operation of one of the power failure phase contact portion and the power feeding phase contact portion to drive the actuator.

2. An actuator driving circuit according to claim 1, wherein the actuator is driven to actuate a safety stop device for preventing a car of an elevator from falling.

3. The actuator driving circuit according to claim 2, wherein the car includes a speed sensor to detect a speed of the car and a breaking system to slow the speed of the car when the speed of the car is detected to be above a first predetermined value, and the power feeding phase contact portion is closed when the speed of the car is detected to be above a second predetermined value, the second predetermined value being higher than the first predetermined value.

4. An actuator driving method of driving an actuator having an electromagnetic coil electrically connected to a charge portion through a discharge switch, comprising:

supplying an electrical power from a primary power source to an operation portion to control a power feeding phase contact portion and a power failure phase contact portion of a discharge switch as a result of an input of an electrical signal from the operation portion, the power feeding phase contact portion having an operating speed higher than that of the power failure phase contact portion; and operating the power failure phase contact portion when the electric power supply is cut to electrically connect the charge portion to the electromagnetic coil and discharge an electric power accumulated in the charge portion to the electromagnetic coil to drive the actuator.

5. An actuator driving method according to claim 4, wherein during a power failure phase of the primary power source, the electric power supply is maintained to the operation portion by using a backup power source.

6. An actuator driving method according to claim 5, wherein the actuator is driven to actuate a safety stop device for preventing a car of an elevator from falling.

7. The actuator driving method according to claim 6, wherein the car includes a speed sensor to detect a speed of the car and a breaking system to slow the speed of the car when the speed of the car is detected to be above a first predetermined value, the method further comprising:

connecting the power feeding phase contact portion when the speed of the car is detected to be above a second predetermined value, the second predetermined value being higher than the first predetermined value.

8. An actuator driving method according to claim 4, wherein the actuator is driven to actuate a safety stop device for preventing a car of an elevator from falling.

9. The actuator driving method according to claim 4, further comprising:

closing the power feeding phase contact portion, as a result of the input of the electrical signal from the operation portion, to electrically connect the charge portion to the electromagnetic coil and discharge an electric power accumulated in the charge portion to the electromagnetic coil to drive the actuator.

* * * * *